United States Patent [19]

Gould et al.

[11] 4,240,063

[45] Dec. 16, 1980

[54] VISOR ASSEMBLY FOR PEDESTRIAN TRAFFIC SIGNAL

[75] Inventors: Samuel Gould, San Pedro; James S. Gould, Los Alamitos, both of Calif.

[73] Assignee: Indicator Controls Corp., Gardena, Calif.

[21] Appl. No.: 59,545

[22] Filed: Jul. 23, 1979

[51] Int. Cl.[3] ..... E01F 9/00; F21V 17/00

[52] U.S. Cl. ..... 340/119; 340/44; 340/87; 116/63 R; 362/186; 362/376; 362/382

[58] Field of Search ..... 340/119, 44, 45, 50, 340/84, 87, 114 RB; 116/63 R, 63 P; 362/185, 186, 190, 358, 359, 376, 382

[56] References Cited

U.S. PATENT DOCUMENTS

| | | | |
|---|---|---|---|
| 2,014,872 | 9/1935 | Wells et al. | 340/50 |
| 3,863,251 | 1/1975 | Gould et al. | 340/382 |
| 4,001,778 | 1/1977 | Ross | 340/119 |

*Primary Examiner*—John W. Caldwell, Sr.
*Assistant Examiner*—Donnie L. Crosland
*Attorney, Agent, or Firm*—Keith D. Beecher

[57] ABSTRACT

A visor assembly for a pedestrian traffic signal which is intended to be mounted across the face of the signal and which serves to screen the signal from sunlight. The visor assembly includes a frame, and an "egg-crate" grating mounted in the frame, the grating being composed of a multiplicity of intersecting webs which provide a plurality of rectangular openings. In accordance with the invention, the grating is locked in the frame by brackets which are slotted to receive the webs, and which are adhesively bonded to one of the webs and to the frame to protect the assembly from vandalism.

2 Claims, 2 Drawing Figures

VISOR ASSEMBLY FOR PEDESTRIAN TRAFFIC SIGNAL

BACKGROUND

A visor assembly of the general type described above is disclosed, for example, in U.S. Pat. No. 3,863,251 which issued Jan. 28, 1975, and which is assigned to the present Assignee. It has been found that visor assemblies of the type described in the patent are subject to widespread vandalism, the vandalism involving twisting and pulling the egg-crate grating out of the frame. Many attempts have been made in the past to render the visor assemblies proof against such vandalism, but these attempts have only been partially successful.

Accordingly, the principal objective of the present invention is to provide such a visor assembly which is virtually proof from vandalism, and yet which may be constructed and assembled with relative ease and simplicity.

DETAILED DESCRIPTION OF THE ILLUSTRATED EMBODIMENT

Figure 1:
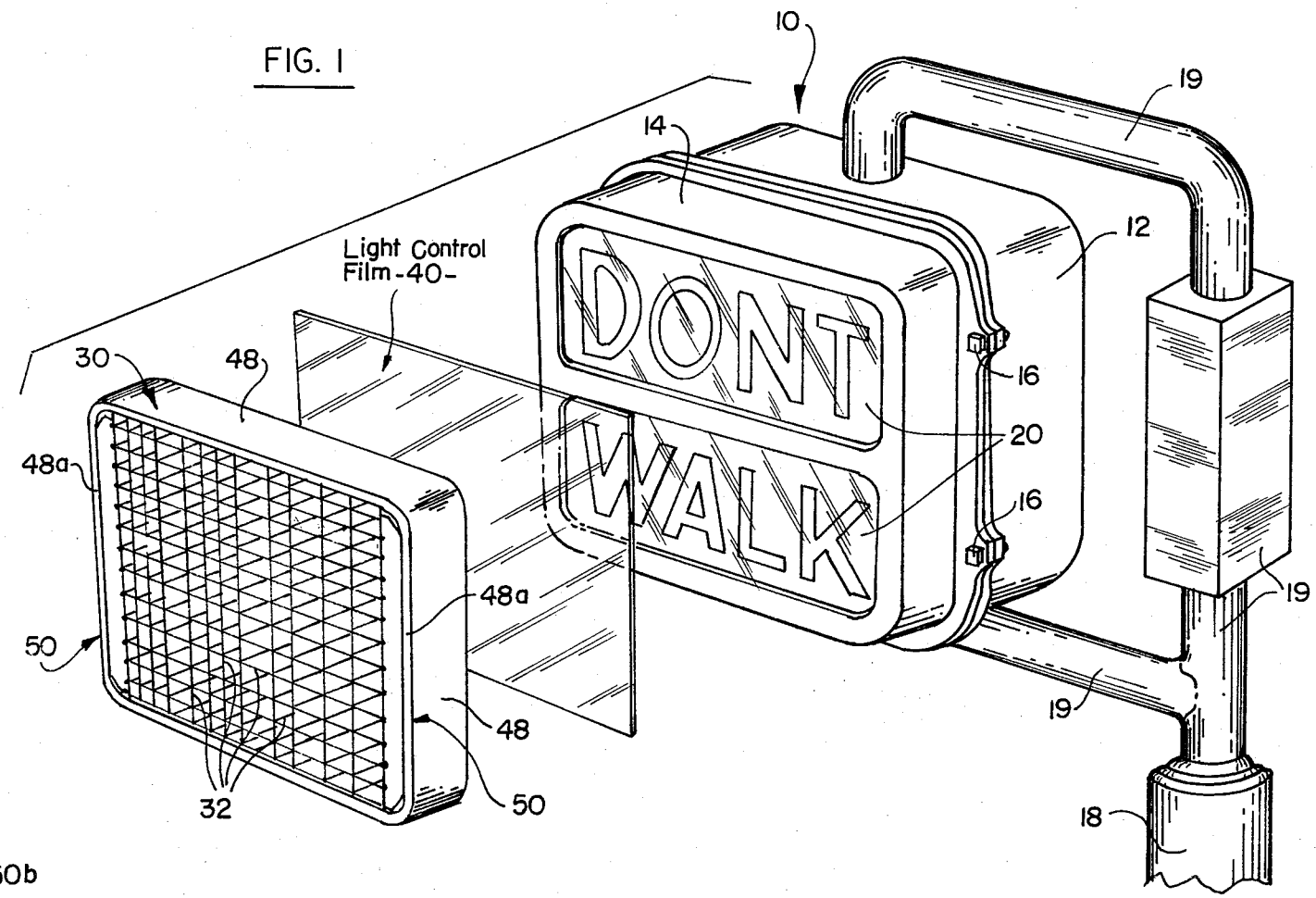
FIG. 1 is a perspective representation of a typical pedestrian traffic control signal, and of a visor assembly constructed in accordance with the present invention, and which is intended to be mounted over the face of the signal.
Figure 2:
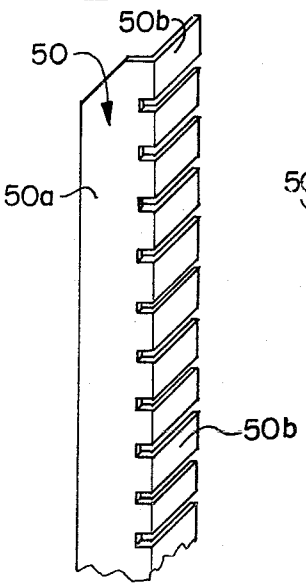
FIG. 2 is a partial perspective view of an anti-vandalism bracket, which is used in the assembly of FIG. 1 to prevent the visor assembly from being vandalized.

The pedestrian traffic control signal illustrated in the accompanying drawing is designated generally as 10. The signal includes a usual housing 12 and a cover 14, the cover being hinged to the housing. The cover may be opened to permit access to the interior of the housing. The cover may be held closed over the front of the housing by means, for example, of bolts 16, or other appropriate fasteners. The pedestrian traffic signal 10 is supported on a usual standard 18 by means of a bracket 19.

As is well known, appropriate light sources are mounted within the housing 12, and these sources are selectively energized so as to illuminate the legend "WALK" on the lower portion of face plate 20, or both the legends "DONT" and "WALK" on the upper and lower portions of the face plate.

As fully described in U.S. Pat. No. 3,863,251, referred to above, a polarized plastic light screen 40 may be mounted over the face of the signal 10 in conjunction with an "egg-crate" grating 30. These elements may be mounted in front of the face plate 20 of the signal which bears the legends "DONT" and "WALK".

The grating 30 is formed by intersecting webs 32 which define a plurality of rectangular openings. These webs perform their intended function of blanking out the legends "DONT" and "WALK" when the corresponding light sources within the signal are de-energized, this being achieved by minimizing reflections on the external surface of the screen 40, even in the presence of strong incident sunlight.

The webs 32 of grating 30 are surrounded by a frame 48. In order to maintain the webs within frame 38, and to preclude vandals from forcing the webs out of the frame, a pair of longitudinal brackets 50 are positioned at each side of the frame, as shown in FIG. 1.

Each bracket 50 is made up of two elongated integral portions **50*a* and 50*b* which are essentially at right angles to one another. The portion 50*a* extends under a rim 48*a* of the frame 48, and the portion 50*b* extends inwardly across the surface of the adjacent web 32. The portion 50*b* is slotted, as shown, to receive the webs 32 which are perpendicular to and intersect the adjacent web. The bracket 50 is adhesively bonded to the inside surface of rim 48*a* and to the surface of the adjacent web 32**, for example, by silicon rubber cement, or other appropriate adhesive.

The resulting assembly is one in which the grating formed by webs 32 is firmly retained within the frame 48, and the entire assembly is relatively proof against vandalism.

Although a particular embodiment of the invention has been shown and described, modifications may be made. It is intended in the claims to cover the modifications which come within the true spirit and scope of the invention.

What is claimed is:

1. In combination with a pedestrian traffic signal of the type having legends selectively illuminated by light sources within the housing of the signal, a grating mounted on the housing in front of the legends composed of a multiplicity of intersecting webs forming a plurality of openings through which the legends are exposed and illuminated by the light sources within the housing; a frame extending around and supporting the webs, said frame having a rim portion extending inwardly from the perimeter of the frame in coplanar relationship with the front of the frame; and at least one elongated bracket having two integral elongated portions positioned at essentially 90° to one another, one of the portions extending under the surface of the rim, and the other of the portions abutting the surface of an adjacent one of said webs and being slotted to receive the webs intersecting said adjacent one of said webs, the respective portions of said bracket being attached to said rim and to said adjacent one of said webs.

2. The combination defined in claim 1, in which the respective portions of said bracket are adhesively attached to the underside of said rim and to the surface of said adjacent one of said webs.

* * * * *